US005309881A

United States Patent [19]

Pawellek et al.

[11] Patent Number: 5,309,881

[45] Date of Patent: May 10, 1994

[54] ENGINE BRAKE FOR A MULTICYCLINDER INTERNAL COMBUSTION ENGINE

[75] Inventors: Franz Pawellek, Marktheidenfeld; Egon Eisenbacher, Karlstadt, both of Fed. Rep. of Germany

[73] Assignee: Mannesmann Rexroth GmbH, Lohr am Main, Fed. Rep. of Germany

[21] Appl. No.: 101,562

[22] Filed: Aug. 3, 1993

Related U.S. Application Data

[63] Continuation of Ser. No. 906,281, Jun. 29, 1992, Pat. No. 5,257,605.

[30] Foreign Application Priority Data

Jun. 28, 1991 [DE] Fed. Rep. of Germany ..... 4121435
Nov. 22, 1991 [DE] Fed. Rep. of Germany ..... 4138447

[51] Int. Cl.[5] ..... F02D 13/04
[52] U.S. Cl. ..... 123/321
[58] Field of Search ..... 123/321, 322, 323, 324, 123/182.1, 325

[56] References Cited

U.S. PATENT DOCUMENTS

| | | | |
|---|---|---|---|
| 4,828,289 | 7/1989 | Meneely | 123/182.1 |
| 4,922,872 | 5/1990 | Nagami et al. | 123/319 |
| 5,012,778 | 5/1991 | Pitzi | 123/321 |
| 5,036,810 | 8/1991 | Meneely | 123/325 |
| 5,048,480 | 9/1991 | Price | 123/321 |
| 5,060,611 | 10/1991 | Krampe et al. | 123/320 |
| 5,088,460 | 2/1992 | Echeverria | 123/321 |
| 5,105,782 | 4/1992 | Meneely | 123/321 |
| 5,165,375 | 11/1992 | Hu | 123/321 |
| 5,195,489 | 3/1993 | Reich | 123/321 |
| 5,201,290 | 4/1993 | Hu | 123/321 |

FOREIGN PATENT DOCUMENTS

| | | | |
|---|---|---|---|
| 18457 | 5/1986 | Austria | 123/321 |
| 083058 | 7/1983 | European Pat. Off. | 123/321 |
| 3026529 | 2/1982 | Fed. Rep. of Germany | 123/321 |
| 4038334 | 11/1991 | Fed. Rep. of Germany | 123/321 |

*Primary Examiner*—Raymond A. Nelli
*Attorney, Agent, or Firm*—Cushman, Darby & Cushman

[57] ABSTRACT

An engine brake for a multicylinder internal combustion engine includes valves that can be periodically opened briefly, in each case outside the exhaust stroke. In the vicinity of the applicable valve drive, a hydraulic piston is provided that is triggered synchronously with the engine rpm via an associated control line by a hydraulic pressure distributor fed by a pump. To improve the accuracy of control over the entire engine rpm range, the various valves are assigned a central positive displacement pump that runs synchronously with the camshaft rpm and whose outlet line leads to the hydraulic pressure distributor, which has a distributor disk. In engine braking operation, an alternating connection of the applicable control line to either the pump outlet line or a low-pressure region of the hydraulic control circuit is effected synchronously with the engine rpm by means of the distributor disk.

46 Claims, 8 Drawing Sheets

ENGINE BRAKE FOR A MULTICYCLINDER INTERNAL COMBUSTION ENGINE

This is a continuation of Application Ser. No. 07/906,281, filed Jun. 29, 1992, now U.S. Pat. No. 5,257,605.

BACKGROUND OF THE INVENTION

1. Field of the Invention

The present invention relates to an engine more particularly, to an engine brake for a multicylinder internal combustion engine brake for a multicylinder internal combustion engine, with valves that can be briefly opened periodically, in each case outside the exhaust stroke.

2. Description of the Related Art

Recently, not only exhaust brakes but so-called decompression brakes have gained a foothold for engine braking systems; they make the compression work of the compression stroke useful for braking by blowoff in the region of the ignition top dead center. This is done by slight or brief opening of the outlet valve or of an additional small valve; metering of the braking output can be done by controlling the opening times. Various models of these decompression brakes have been introduced, for instance in a special printing of ATZ Automobiltechnische Zeitschrift (Automobile Engineering Journal) 90 (1988), No. 12, in the article entitled "Die Motorbremse von Nutzfahrzeugen—Grenzen und Moglichkeiten zur Weiterentwicklung" (Engine Brakes in Utility Vehicles—Limits and Opportunities for further Development). One model for instance provides that with the engine brake turned on, the outlet valves are also opened at the end of any given compression stroke, via telescopingly extendable valve tappets. The telescoping extension of the valve tappets is done via positive displacement pistons, which are driven by a cam located on the inside, while the return of the valve tappets to the normal length is done via unlockable check valves, which are opened and closed simultaneously by a central, pneumatically triggered control disk. However, the known control circuit has a relatively complex structure in terms of circuitry and equipment, which also makes its assembly complicated and expensive. Controlling the valves exactly in terms of time also presents difficulties, especially at high rpm.

German Patent 30 26 529 discloses a decompression engine brake for a multicylinder internal combustion engine, in which a controllable telescoping part embodied as a piston, which is disposed in the valve tappet and is hydraulically actuated, is provided in the valve linkage of the applicable outlet valves, in order to vary the effective length of this linkage in the direction of an opening movement of the outlet valve. Triggering the telescoping part is done via individual control lines, to each of which one positive displacement piston is assigned. The positive displacement pistons ar guided radially in a housing and are driven by an inner cam, which is rotated synchronously with the camshaft. For each individual pump piston, one unlockable check valve is provided; a central, pneumatically triggered control disk serves to open and close all the check valves simultaneously.

Because in this known case a separate pump with a control circuit is assigned to each individual cam drive, the structure in terms of circuitry and apparatus is relatively complex. This not only makes assembly of the components required for the engine brake difficult, but with this known apparatus it also becomes difficult to control the valves correctly in terms of time, especially at high rpm, and thus to meter the engine brake correctly.

European Patent Disclosure A 83058 discloses an engine brake in which a central pump is used. However, for each engine valve to be actuated, one dispenser piston and one receiver piston are provided; the receiver piston actuates the engine valve, and the dispenser piston is actuated indirectly by the camshaft. A hydraulic valve is connected to the output side of the pump, but it has solely an activation and filling function for the engine brake system. Accordingly, this hydraulic valve simply performs the function of turning the engine brake on and off. Because of the provision of a separate dispenser and receiver piston for each engine valve, the structure of the engine brake continues to be relatively complex.

SUMMARY OF THE INVENTION

Attempts have already been made to simplify the control of the engine brake by providing a pump that feeds a hydraulic pressure distributor that is run synchronously with the engine speed, and in this way triggers the individual valves with precisely chronological tuning. The object of the present invention is to improve the engine brake for a multicylinder internal combustion engine, with valves that can be briefly opened periodically, in each case outside the exhaust stroke, such that a chronologically exact triggering of the valves is assured in all operating states of the engine, and in particular over the entire operating rpm range; the expense in terms of the apparatus for correct association of the distributor control with the engine kinematics should be kept as low as possible.

According to the present invention, the various valves, which can be opened in clocked fashion, are assigned one central pump, whose outlet side is located at a distributor that then performs the distribution of the high pressure to the various individual control lines synchronously with the engine operation. This has the advantage that the triggering of the various hydraulic pistons can be carried out in a chronologically precise fashion at relatively low expense . Because of the central pressure production, the control circuit can also be simplified. Specifically, an individual switching valve suffices to turn the hydraulic brake on and off. Because the positive displacement pump runs synchronously with the camshaft rpm, there is the further advantage that the supply quantity is automatically adapted to the volumetric flow requirement of the engine brake valve, over the entire rpm range of the engine. It is thus possible on the one hand at high rpm to furnish adequately high quantities of hydraulic medium, at operating pressure. On the other hand, the power consumption of the pump can be kept minimal at low rpm. The use of a central positive displacement pump running synchronously with the camshaft rpm has the further advantage that pressure fluctuations in the individual control lines can be smoothed with relatively simple engineering provisions. For instance, this can be done by simple means by providing that the pump outlet region communicate with a high- pressure buffer device, for example in the form of a high-pressure buffer piston, so that the chronological control of the various engine brake valves can be done still more accurately. Even in the intake region of the central positive displacement pump very effective smoothing of the intake pressure of the positive displacement pump can be assured with an individual pressure regulating valve, which is still more beneficial in terms of timing of the various hydraulic pistons. A conventional lubricant oil pump can be used as the source of the hydraulic medium.

If the distributor disk of the hydraulic pressure distributor, which is supplied by the positive displacement pump, revolves together with the positive displacement pump at the same rpm, then the control of the distributor can be associated very simply with the applicable engine kinematics. As a result, while its construction is unaltered, the hydraulic pressure distributor can be used for the most various engine models; at most, the distributor disk might have to be replaced in order to adapt it to the applicable engine type. A particularly simple arrangement is achieved if the distributor disk is driven together with the rotor of the positive displacement pump. In this way, the production, accumulation and distribution of pressure can all be done in the rotating part, so that the number of rotary leadthroughs or rotary transmissions can be kept as low as possible. This also greatly simplifies the drive for the distributor disk.

Preferably, the positive displacement pump is formed by a radial piston pump that in an advantageous embodiment has five work pistons. With this kind of pump, a uniform pump stream, i.e., a volumetric flow with slight volumetric and pressure fluctuations, can be attained.

In another advantageous feature, the work pistons are arranged in a rotor such that the work chambers are located radially on the inside. The high pressure produced by the various work pistons can in this way be collected in the center of the rotor and thus within a small space. In this region, pressure exchange can be provided with minimum losses via a sliding ring arrangement, because only a very small sealing face and thus a small friction radius are involved, and as a result, very low forces of friction are produced, since the axial pressure forces between the stationary and the rotating part can be kept relatively small.

The design of the engine brake according to the present invention affords the possibility of accommodating the elements for controlling the engine brake, such as the pressure limiting valves, volume reservoir devices and switch valves, in the rotating part or in other words in the rotor itself, so that a pressure exchange between a rotating and a stationary part can be dispensed with entirely. With the mode of operation of the pump piston radially on the inside and the accumulation of the pressure in the center of the rotor, however, favorable conditions are also created for the case where these components are accommodated in the stationary part, in other words in the rotor housing, because the pressure transmission in the form of the rotary leadthrough can be accommodated in the smallest possible space and operates with good efficiency. In that case, the rotor can be reduced in volume, so that the mass that is moved can be kept as small as possible, which is beneficial in terms of response performance.

In accordance with a further feature of the present invention, the close-fitting reception of the rotor in the stationary part, that is, in the rotor housing, is advantageously exploited to form a low-pressure distributor chamber, from which the various work chambers of the pump pistons are supplied. The provision of this kind of central low-pressure distributor chamber or low-pressure intake chamber leads to further smoothing of the high pressure present at the distributor disk, thereby further improving the accuracy of control of the decompression valve.

If one substantially axially aligned suction and pressure conduit is assigned to each work chamber of the pump, these conduits being supplied from the common low-pressure intake chamber via an associated suction valve, then the bearing tang required in any case for the rotor is utilized as space-savingly as possible to furnish the suction and pressure conduits.

In accordance with a further feature of the present invention, the length of the connecting line between the various positive displacement chambers of the pump and the control plane of the distributor disk can be minimized. In accordance with this provision, all the pump positive displacement elements are assigned one joint outlet valve element, which moreover is especially simple in design.

In accordance with yet a further feature of the present invention, the bearing tang for the rotor is additionally utilized to support the distributor disk. This design furthermore affords the opportunity of using the rotor for axial support of the distributor disk as well.

By the axially movable disposition of the distributor disk on the bearing tang, provision can be made so that the distributor disk always rests flush against the counterpart face of the control plane, to keep leakage losses as low as possible and as a result to increase the accuracy of control further. Automatic readjustment of the control disk is obtained in accordance with a further feature of the present invention. That feature produces a hydrostatic overpressure on the distributor disk, resulting in its leakage-free contact with the control face.

The activation and deactivation of the decompression engine brake, in accordance with an advantageous further feature of the present invention, is provided by making the pump outlet line connectable to a relief line via a triggerable multiposition valve. If the multiposition valve is switched in the open position, the various pump pistons positively displace the hydraulic fluid, which has arrived from the low-pressure region, back into the low-pressure region in a short-circuited loop. With the multiposition valve closed, hydraulic medium is backed up in the relief line, so that the pressure in the region of the distributor disk can build up; this pressure is then imparted in clocked fashion to the various decompression valve pistons by the rotary motion of the rotor and hence of the distributor disk. With the engine brake activated, pressure accordingly builds up very quickly in the various control lines and then—especially at high rpm—has to be reduced again, likewise in a short time. To assure that these pressure fluctuations have the least possible influence on the accuracy of engine brake control, the relief of the control line is provided to the low-pressure region, which is preceded by a pressure regulating valve. The pressure regulating valve is located in the supply line for the control circuit of the engine brake, which is supplied for instance from the lubricant oil pump of the engine. The pressure regulating valve is adjusted to a pressure of 1.5 bar, for instance, and accordingly is in a position to assure the most uniform possible pressure conditions in the low-pressure region, and in particular to preclude pressure surges and excessive pressure drops. Any volumetric and associated pressure fluctuations that might then occur can be further smoothed by an additional low-pressure damper.

In accordance with another feature of the present invention, the hydraulic piston triggered by the control line has a hydraulic stop as a stroke limitation. This has the particular advantage that pulsation is effectively checked, particularly in the returning hydraulic fluid. The hydraulic stop for the hydraulic pistons of the decompression valves assures that the compression volume is already relieved to a certain extent during motion, which has the additional advantage that in the region of the hydraulic stop the control circuit is opened, so that any gas bubbles in the control system can be carried away at that point. Finally, another advantage of this further feature is that a direct metal-to-metal contact is avoided, so that besides the advantage of noise abatement, the components to the valve control are extensively protected and accordingly have a long service life.

With the engine brake described thus far, for the sake of chronologically correct delivery of the high pressure to the decompression valve control lines and connecting them subsequently to low pressure in a clocked fashion, a central positive displacement pump cooperates with a distributor disk that revolves synchronously with the camshaft rpm. A spring-loaded piston reservoir is inserted on the pump compression side in order to seal it off from high pressure. As a result, chronologically exact triggering of the valves can be assured in all operating states, at very little expense in terms of technical apparatus.

Another object of the present invention is to improve such an engine brake so that it permits precise valve triggering at little expense for technical apparatus.

In the engine brake according to the invention, the control lines for the decompression valve accordingly continue to communicate with the high-pressure side of the pump or with low pressure under the control of a central distributor disk. The advantages that can be attained as a result have already been described in detail above. To smooth pulsation in the high-pressure region, a volume resonator is now used, so that pressure fluctuations in the high-pressure region, which can be caused by processes of opening and closing the decompression valves, pump operation and the like, can be reliably smoothed. The high-pressure side is stabilized as a result, which further promotes chronologically correct control of the decompression valves. The use of a volume resonator instead of a spring-loaded piston reservoir as a high-pressure reservoir for the engine brake has the advantages that no moving parts are needed, and wear phenomena are thus precluded. The result is an extremely long service life. Moreover, no problems whatsoever in terms of resonant frequency and dynamics arise, so that operating characteristics are extremely stable. In addition, the requisite engineering effort and expense are extremely low. Another advantage is the possibility of extremely simple adaptation of the reservoir volume to the storage demand. Compared with piston and diaphragm type reservoirs with gas prestressing, the volume resonator also has the advantages that no prestressing losses whatever can occur from gas diffusion through the separating diaphragm or piston seal. Moreover, the volume resonator has full function over the entire temperature range; that is, it works independently of temperature. Moreover, the high-pressure region is simple to vent. Wear phenomena in moving parts are likewise precluded in the volume resonator.

The stationary disposition of the volume resonator permits simple assembly and access to the volume resonator, as well as problem-free maintenance and readjustment as needed. The axial alignment between the volume resonator inlet opening and a conduit that carries the high pump pressure and rotates with the pump rotor leads to a highly effective volume resonator function, since pressure pulsations are decoupled directly from the conduit carrying the pump pressure to the volume resonator and are reduced there. The transition between the rotating and the stationary region, which is located between the volume resonator and the rotating conduit, thus causes no impairment whatsoever of the volume damper function.

The disposition of the outlet opening of the rotating conduit in a chamber that contains not only the volume resonator inlet opening but also a pressure limiting valve results in a relatively compact design. Especially if the chamber can be made to communicate with the low-pressure region selectively via an on/off valve, the chamber can thus have a central pressure control function within a small space.

In another embodiment of the present invention, the volume resonator revolves with the pump rotor; that is, it is connected to the rotating part of the engine brake. This has the additional advantage of improving pulsation smoothing, since there is a flow through the reservoir volume. The possibility is also afforded of automatic venting, specifically by exploiting centrifugal force and the differing density of air and oil. Moreover, no rotary leadthrough to the stationary part is needed—except for the control plane between the revolving distributor disk and stationary openings of the control lines—resulting in optimal efficiency with extremely slight leakage.

Especially when the volume resonator is integrated with the pump rotor, there are the further advantages that the existing space is optimally utilized; in other words, an extremely compact design of the engine brake is attained. In addition, even if there is a possible leak in the high-pressure region, no leakage can reach the outside, and so the system is extremely leakproof.

The use of an elastic valve tape to seal off the volume resonator from the pump makes an extremely simple achievement of valve function possible, at very low expense for assembly and maintenance; at the same time, a plurality of connecting openings located in the plane of the valve tape between the pump and the volume resonator can be selectively opened and closed by means of the valve tape in accordance with the pressure condition prevailing at that time.

By radially and axially staggering the inflow and outflow conduits of the volume resonator, the flow through it is still further improved, so that the pulsation smoothing attainable is simultaneously increased as well.

Optimal utilization of the available installation space is attained by the disposition of a low-pressure damping chamber in the interior of the volume resonator. The space thereby created can be filled with the low-pressure damping chamber, so that low-pressure damping is simultaneously attainable without notably increasing the installation space.

The low-pressure damping chamber may perform not only its actual function of low-pressure damping but also the further function of intended, defined leakage, in that a defined flow of pumping medium flows out via the close-fit play of its piston. This defined leakage flow is replaced by delivering a suitable quantity of fresh oil to the system inlet, which accordingly effects a defined cooling of the system. Consequently the damping chamber piston also functions as a damping throttle for carrying away a defined coolant flow.

A particularly simple structural embodiment is attained if the high pump pressure is delivered to the distributor disk on its end face remote from the control lines. The pumping medium, which is at high pressure, can thus flow axially through the control disk, so that there are no losses from deflection. At the same time, the high pressure acting upon the back of the distributor disk prestresses it in the control plane, assuring a flush, substantially leakage-free contact of the distributor disk with the stationary part.

In addition, the control disk can also be manufactured very simply, if it has only axially extending conduits for carrying the high pump pressure and the low pressure. The control disk can advantageously be made from sintered ceramic material, resulting in high abrasion and erosion resistance. The distributor disk thus has an extremely long service life.

In an advantageous feature, there is a stationary pressure limiting valve that is disposed concentrically with the pump rotor. The concentric valve disposition has the further advantage that the cooperation with the high-pressure portion located in the rotor takes place in the region of the lowest possible circumferential speeds, so that the valve function is reliably assured and abrasion and friction effects are minimized. These last effects can be still further reduced by using an axial pressure exchange.

The characteristic that an adjustable, preferably electrically controllable pressure limiting valve is provided on the pump compression side, the valve adjustment of which controls the level of the high pump pressure at any given time, also gains special significance. That is, according to the present invention, by means of this kind of pressure limiting valve, the engine braking output could surprisingly be adjusted in an infinitely graduated way. By the variation of the effective high- pressure level that is possible according to the present invention, the engine braking output can accordingly be varied in a simple way. This can be exploited for instance for gentle actuation of the engine brake by a retarded, ramp-like rise in the high pressure, under the control of the pressure limiting valve. This also makes it possible to include ABS. The maximum engine braking output can also be varied selectively in that case. This adjustment option can also be used independently of the use of a volume resonator as a high-pressure damper and of the use of a central pump and a distributor disk. However, in this possibility of engine braking output adjustment by varying the high-pressure level, the system design with the volume resonator and distributor disk provides very favorable effects, particularly since the function of the volume resonator is substantially independent of whatever high-pressure level has been established at a given time.

The pressure limiting valve, embodied as a DBE valve, can be used not only for infinitely graduated adjustment of the engine braking output but also to switch over from the drive mode to the braking mode, and to seal off the high-pressure loop in the braking mode. With only a single valve, the functions of "turn-on-and-turn-off of the engine brake", "maximum pressure limitation of the system pressure" and "infinitely graduated adjustment of the brake output by pressure variation" can thus be attained. Particularly with respect to the latter functions, it was recognized that the extension travel of the actuating pistons at the decompression valves is directly dependent on the pressure level at the pump.

Extremely good controllability is attained if the pressure limiting valve is designed as a proportional pressure limiting valve. The system pressure can thus be controlled and varied in a simple manner via the magnetic current.

Taking the above into account, the present invention therefore also creates a method of variable adjustment of the braking output of an engine brake, in which the high pressure applied to the decompression valves for their opening is variable in accordance with the desired braking output.

Exemplary embodiments of the invention are described in further detail below, in conjunction with the schematic drawings.

DETAILED DESCRIPTION OF THE PRESENTLY PREFERRED EXEMPLARY EMBODIMENTS

Figure 1:
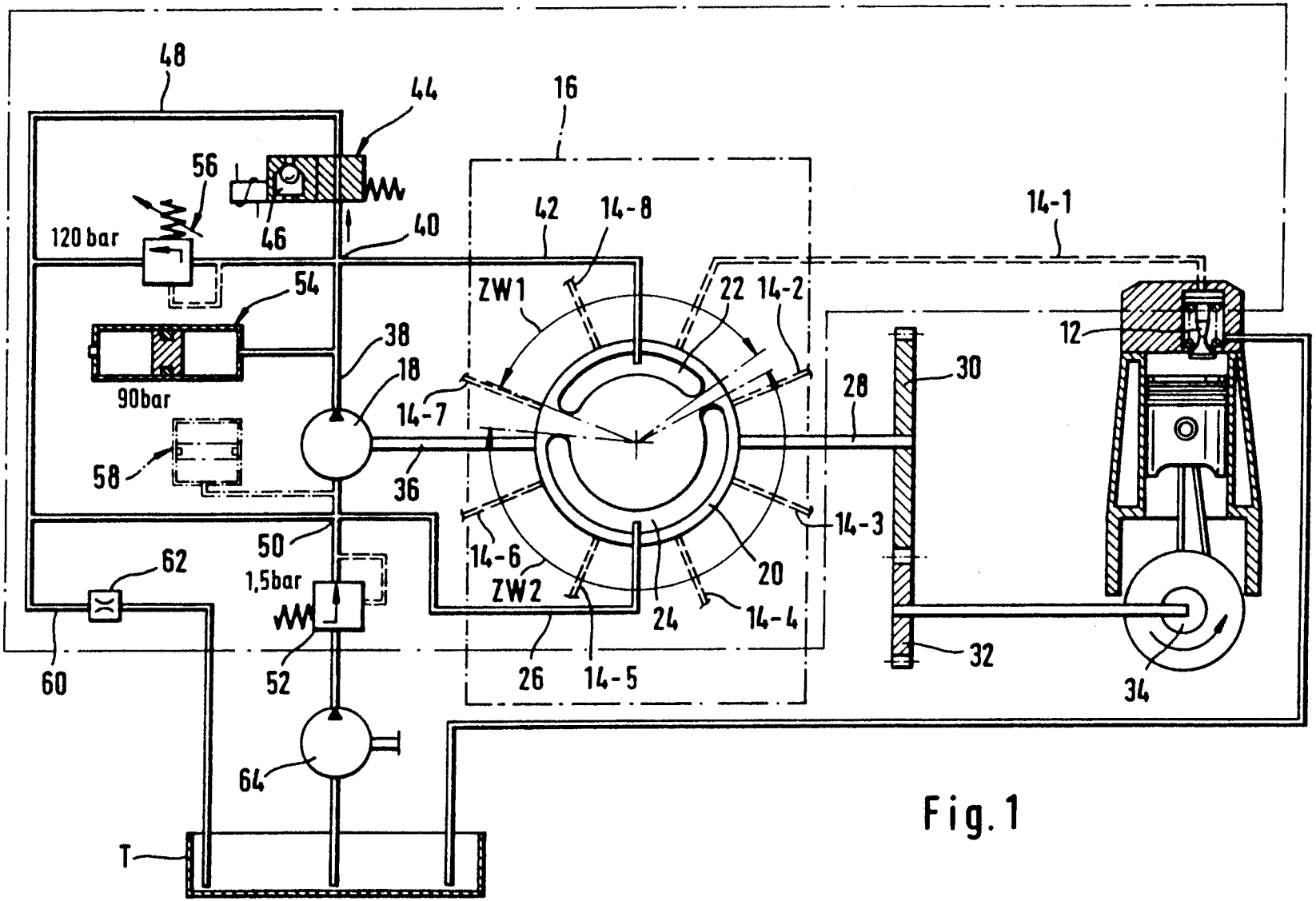
FIG. 1 is a schematic block circuit diagram of the hydraulic control circuit for the engine brake.

FIG. 1 schematically shows the hydraulic control circuit and the control arrangement for an engine brake that operates by the principle of a decompression brake. The engine brake is designed for an internal combustion engine with eight cylinders, but to simplify the drawing only one combustion chamber with a decompression valve is schematically shown. The engine brake operates in accordance with the principle that either the outlet valve itself or an additional valve 12, hereinafter called a decompression valve, is briefly opened. In this way, by blowoff, the compression work of the compression stroke is made useful for braking.

The actuation of the decompression valve is done by means of a hydraulic piston, not shown in detail in FIG. 1, which is triggered by an associated control line 14-1 through 14-8. To simplify the drawing, only one control line 14 is shown in its entirety.

One separate individual control line 14, which begins at a hydraulic pressure distributor 16, is provided per decompression valve. In a chronologically clocked manner, the hydraulic pressure distributor, whose structure is to be described in detail hereinafter, distributes the hydraulic fluid pressure furnished by a pump 18 to the applicable control lines 14-1 to 14-8 to be opened and then relieves them again at given times, so that opening and closing of the decompression valves 12 is synchronized with the engine rpm. In order to be able to carry out the control of the decompression valves over the entire rpm spectrum of the engine with the greatest possible accuracy, the control apparatus has the following structure described below:

The high-pressure distributor has a slit control disk 20, which has two regions distributed over its circumference. A first slit recess 22 in the form of a segment of a circle communicates with the starting pressure of a positive displacement pump 18 that runs synchronously with the crankshaft rpm and thus with the camshaft rpm. The circular segment slit recess 22 extends over a first central angle ZW1. A further circular arc slit 24, which communicates with a low-pressure region of the hydraulic control circuit extends substantially over the same radius as the circular segment slit recess 22 and over a second complementary central angle ZW2 that with the angle ZW1 substantially adds up to 360°. In the specific exemplary embodiment here, the circular arc slit 24 is connected to the suction side of the pump 18 via a line 26.

As the double line 28 indicates, the slit control disk or distributor disk 20 is driven via a drive wheel or pinion 30, which via a counterpart wheel 32 is given a drive derived from the crankshaft 34. The gear ratio between the wheels 32 and 30 is 1:2, so that the pinion 30 is driven at an rpm that is exactly equivalent to that of the camshaft of the engine. It is therefore possible to dispose the pinion 30 on an extension of the engine camshaft and in this way to furnish an rpm that is synchronized with the camshaft. The circular segment slit recesses 22, 24 are therefore moved past the mouths of the control lines 14, which are not shown in further detail, at precisely the exact time at any engine rpm, resulting in clocked opening and closing of the decompression valves 12.

The further double line 36 indicates that the pump 18 is likewise driven at the same rpm as the pinion 30 and the distributor disk 20. In other words, the pump 18 revolves synchronously with the camshaft rpm, so that the supply quantity of the pump is automatically adapted to the volumetric flow demand of the engine brake, over the entire rpm range of the engine. The pump outlet line is identified by reference numeral 38 and leads to a branching point 40, from which a pressure feed line 42 that leads to the circular segment slit recess 22 branches off.

The engine brake can be turned on and off by a multiposition valve 44, which for instance is electrically actuated. With the multiposition valve 44, in the form of a 2/2- way valve with an integrated check valve 46, the pump outlet line 38 can be selectively relieved to such a low pressure level that the pressure fed to the circular segment slit recess 22 is no longer adequate to actuate the various decompression valves 12. In the specific exemplary embodiment, a controlled connection with a relief line 48, which communicates with the suction side 50 of the pump 18, takes place by way of the multiposition valve 44.

In order to preclude or smooth pressure fluctuations and surges in the hydraulic circuit as extensively as possible, the following circuitry provisions are made:

The pump 18 is embodied by a multipiston positive displacement pump, for example in the form of a radial piston pump with five positive displacement pistons, and its structure will be described in detail hereinafter, in conjunction with FIG. 2. The pump aspirates hydraulic fluid from a low-pressure region, whose pressure level is kept at as constant a value as possible, such as 1.5 bar, by a pressure regulating valve 52. The pump outlet line 38 is connected to a high-pressure buffer piston 54, which is designed for a pressure of 80 bar for instance. Connected parallel to the multiposition valve 44 is a pressure limiting valve 56, which is adjusted to a limit pressure of 120 bar, for instance. Additionally, the low-pressure region may be equipped with a low-pressure damper 58, for further smoothing of volumetric and pressure fluctuations in the suction region of the pump 18.

Particularly to reduce the pressure fluctuations in the flow of hydraulic fluid returning from the decompression valves, the suction side 50 is relieved to the tank T via a scavenging oil line 60, in which a drain throttle or coolant throttle 62 is disposed. This scavenging oil and any leaking oil that might also occur is then replaced again by the lubricant oil pump 64, which is driven by the engine and is provided in the line to the pressure regulating valve 52. This continuous leakage flow via the throttle 62 can be used to cool the hydraulic oil.

A preferred structural embodiment of the engine brake and control circuit will now be described in detail, referring to FIG. 2. The components that have already been discussed above in conjunction with FIG. 1 in the explanation of the hydraulic control circuit are provided with the same reference numerals in FIG. 2.

A housing 66, 68, which for instance is in multiple parts, is fastened by fastening screws 70 to an engine block 72 in which the engine-driven lubricant oil pump 64 is also accommodated. The gear wheel 30 that steps down the rotary motion of the crankshaft at a ratio of 1:2 is mounted on a pump rotor 74 in a manner fixed against relative rotation and displacement. This rotor 74 has two bearing regions 76 and 78, which are located on both sides of a substantially centrally provided working region 80, which has a larger diameter than the two bearing regions 76, 78. Cup-shaped positive displacement pistons 84 are slidingly displaceably received in this working region 80 in five radial bores 82, which are spaced apart from one another by an angle of 72°; these pistons 84 are supported by their radially outer bottom surface 86, each on one roller 88, which rolls along an eccentric running surface 90. The cup-shaped positive displacement piston 84 is pressed radially outward by means of a compression spring 92 in contact with the roller 88, so that upon rotary motion of the rotor 74, a radially oscillating motion of the positive displacement piston 84 is established. Upon radially inward motion, the positive displacement piston 84 executes a pumping stroke, while upon radially outward motion it executes an intake stroke.

Reference numeral 94 indicates the work chambers of the radial piston pump 18, which can each be supplied with hydraulic fluid from a low-pressure intake chamber 98, each via a respective pressure and suction line 96. The low-pressure intake chamber 98 is defined on one end on the bottom 100 of an axial bore 102 in the housing 68 and on the other by a pressure plate 104 that is screwed to the face end remote from the gear wheel 30 of the pump rotor 74. The respective pressure and suction conduits 96 are each closed off by a valve plate 106 that functions as a check valve or suction valve closing body.

In the working region 80 of the rotor 74, this rotor forms a radial shoulder 108, on which the distributor disk 20, slipped onto the rotor 74 with a sliding fit, rests. The distributor disk 20 is connected by means of a pin 110 to the pump rotor 74 in a manner fixed against relative rotation, but in the axial direction it is movably supported on the rotor 74. The radial end face 112 remote from the gear wheel 30 comes to rest in the control plane ES, which is defined by the end face 114 of an inner housing shoulder. Axial bores 116 are provided in this end face 114, distributed uniformly over the circumference and each discharging into an associated radial bore 118 for connection to the applicable individual control lines 14-1 through 14-8. The control lines lead to the control pressure chamber 120 of the at least one associated decompression valve 12 of the applicable cylinder.

Figure 2:
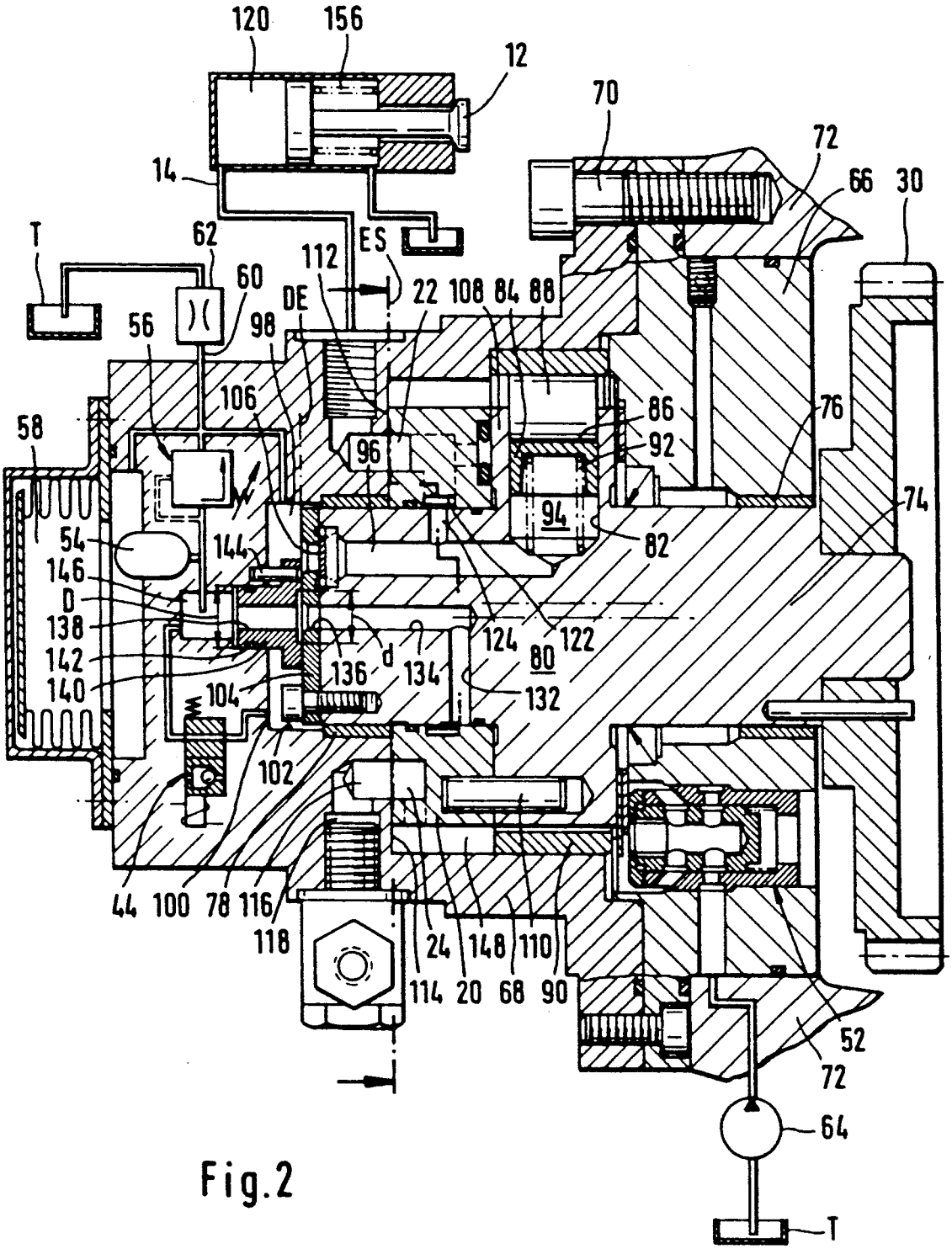
FIG. 2, partly in highly schematic form, is a section through the control mechanics of the engine brake of FIG. 1.
Figure 5:
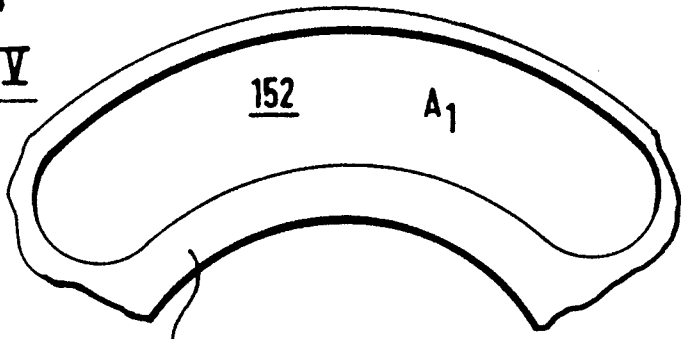
FIG. 5 is a front view of the control disk in the direction V of FIG. 3.
Figure 3:
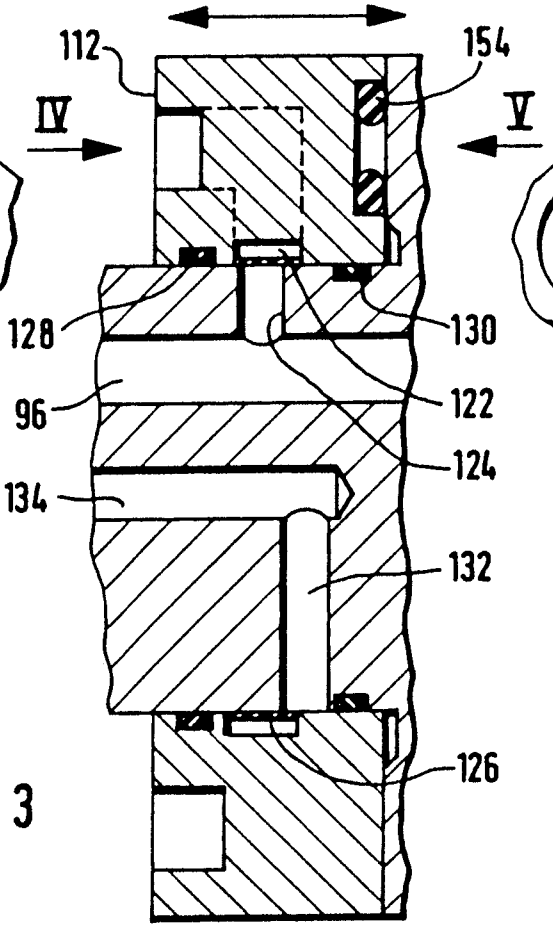
FIG. 3, on an enlarged scale, shows a detail of the arrangement of the distributor disk on a bearing tang of the rotor in accordance with FIG. 2.
Figure 4:
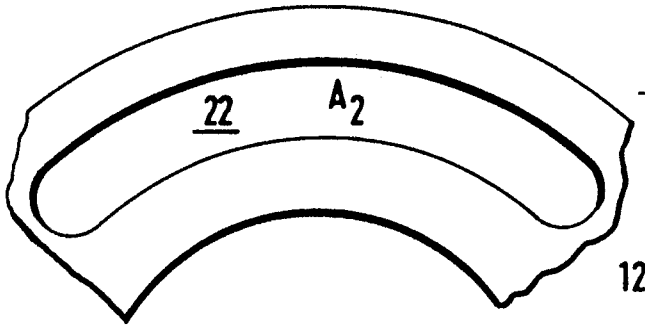
FIG. 4 is a front view of the control disk in the direction IV of FIG. 3.

In the view shown in FIG. 2, the circular segment slit recess 22 is at the top, while the circular arc slit 24 complementary to it can be seen in the lower half of FIG. 2. Dashed lines indicate a connection between the circular segment slit recess 22 and an annular chamber 122 in the control disk 20 (see FIG. 3), which is located in a region at which radial tie conduits 124 extend away from the suction and pressure conduit 96. The radial tie conduits 124 are covered by a valve ring 126, which is formed by an elastic tape that can expand radially outward, into the annular chamber 122, when pressure from a radial tie conduit 124 is imposed at that point. Seals 128, 130 are provided on both sides of the annular chamber 122, to keep the leakage losses as low as possible.

Also discharging into the annular chamber 122, besides the radial tie conduits 124, are a plurality of axially and circumferentially staggered radial conduits 132, which converge in a central blind bore 134 that begins on the side of the low-pressure intake chamber 98. The blind bore 134 merges with a central recess 136 in the pressure plate 104, and on the other side of a rotary transmission plane DE it continues in the form of a through bore 138 of a rotationally symmetrical axial slide block 140. The axial slide block is received in a sealed manner by seal 142 in a bore, not shown in detail, of the stationary housing 68 and is secured against torsion by means of a pin 144. The through bore 138 discharges into a chamber 146, at which one line leads to the multiposition valve 44 on one side and one line leads to the pressure limiting valve 56 on the other.

The bores 132, 134 are a component of a pressure accumulation volume, whose triggering via the multiposition valve 44 makes it possible to turn the engine brake on and off.

Although not shown in detail, the low-pressure intake chamber 98 communicates hydraulically with an annular chamber 148, which on one side communicates with the circular arc slit 24 and on the other is supplied with the starting pressure of a pressure regulating valve 52 that is built into the housing part 66. The pressure regulating valve 52 keeps the pressure in the low-pressure region 148, 24, 98 at a constant level of, for example 1.5 bar.

To keep the leakage losses low in the region of the rotational transfer between the pressure plate 104 and the axial slide block 140, on the one hand, and in the region of the control plane ES on the other, the following provisions are made:

The outside diameter D of the axial slide block 140 is kept larger than the diameter d of a recess in the contact end face of the axial slide block 140. As a result of the axially movable support of the axial slide block in the stationary housing 68, the high pressure that builds up in the chamber 146 assures that the axial slide block 140 is pressed against the pressure plate 104, thus always assuring flush contact.

An indentation 152, which is acted upon by the same pressure as the circular segment recess 22 via a connection indicated by dashed lines, is embodied in the region of the control disk 20, in axial alignment with the circular segment slit recess 22, in the support face 150 that is plane-parallel to the radial end face 112. The face A1 of the indentation 152 is kept larger, however, than the face A2 of the circular segment slit recess 22. The difference in area effects a hydrostatic overpressure and thus an automatic readjustment of the distributor disk, so that that disk always rests flush against the control face, without leakage. In an advantage feature, the face A1 is enclosed by an elastic seal 154.

Reference numeral 58 indicates a damping chamber mounted concentrically on the housing 66, 68; it communicates with the low-pressure region downstream of the pressure regulating valve 52 and additionally contributes to smoothing pressure fluctuations in the low-pressure region. Reference numeral 60 indicates a scavenging oil line, in which the drain throttle 62 is disposed.

Figure 6:
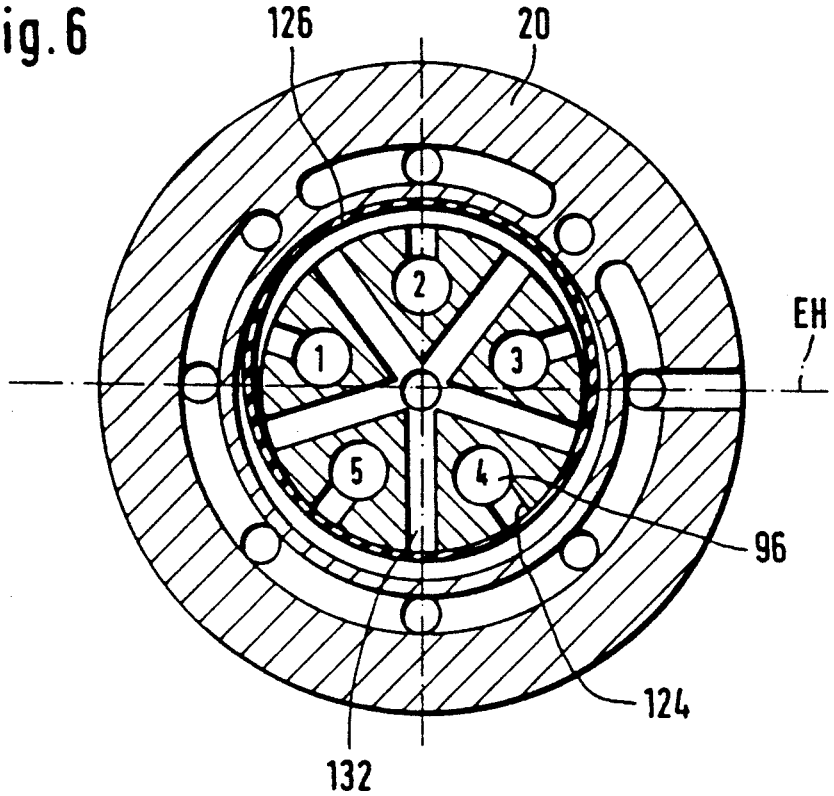
FIG. 6 is a section taken along the line VI—VI of FIG. 2.

In the position of the multiposition valve 44 shown in FIGS. 1 and 2, the engine brake control functions as follows:

With the engine running, the lubricant oil pump 64 furnishes pressure that is reduced to approximately 1.5 bar by the pressure regulating valve. The pressure regulating valve thus supplies the low-pressure region of the engine brake control. A regulated low pressure correspondingly prevails in the low- pressure intake chamber 98, the annular chamber 148, and the circular arc slit 24. At the same time, the pump rotor 74 rotates, and the eccentricity of the eccentric running surface 90 is selected such that whichever positive displacement piston 84 is located above an axial plane, in this case a horizontal plane EH, executes a positive displacement stroke, while the other two positive displacement pistons, which are located below the horizontal plane EH, execute an intake stroke. Pressure accordingly builds up in the axial bores 96 located above the horizontal plane EH, which are marked 1, 2 and 3 in FIG. 6, while an intake process takes place in the other axial bores, which are marked 4 and 5 in FIG. 6. The positive fluid displacement in the bores 96-1, 96-2 and 96-3 causes the valve ring to lift away from the associated radial tie conduits 124-1, 124-2 and 124-3, while the pressure difference between the annular chamber 122 and the lines 96-4 and 96-5 assures that the elastic valve ring 126 firmly closes the associated radial tie conduits 124-4 and 124-5. The associated pistons 84-4 and 84-5 correspondingly aspirate hydraulic fluid from the low-pressure intake chamber 98 via the valve plates 106.

The hydraulic fluid positively displaced by the pistons 84-1 through 84-3 reaches the annular chamber 122 as a result of the lifting of the valve ring 126, but with the multiposition valve 44 opened, it flows radially inward via the adjacent radial conduits 132 to the central bore 136, and from there via the rotary leadthrough or pressure exchange into the chamber 146 and then via the multiposition valve 44 into the low-pressure intake chamber 98. The positive displacement pump is thus short-circuited; that is, it is in a standby mode.

The pressure is also propagated from the annular chamber 122 to the circular segment slit recess 24. However, the pressure level is so low that the control pressure chamber 120 approached by the particular control line 14 that has been opened is at such a low pressure that the force of a restoring spring 156 cannot yet be overcome. Pressure fluctuations in this deactivated state of the engine brakes are reduced on the one hand via the scavenging oil line 60 and on the other via the low-pressure damper 58; at the same time, continuous cooling of the hydraulic fluid takes place through the drain throttle 62. This hydraulic fluid and any leaking hydraulic fluid is replaced again via the lubricant oil pump 64.

If the engine brake is to become active, then the multiposition valve 44 is shifted to its other switching position. As a result, the hydraulic fluid is backed up upstream of the multiposition valve 44, in other words in the chamber 146, in the through bore 138, in the blind bore 134, and in the radial conduits 132, so that a high pressure is built up that is propagated via the annular chamber 122 and the connection with the control plane ES, represented by dashed lines. Each time an axial bore 116 comes to coincide with the circular segment slit recess 22, the associated control line 14 is acted upon by high pressure, so that the associated decompression valve 12 is opened until such time as the central angle ZW1 (see FIG. 1) has been traversed. Then, the axial bore comes to coincide with the adjacent circular arc slit 24, so that the associated control pressure chamber 120 is again relieved in favor of the low-pressure region.

Pressure fluctuations or pressure surges in the high-pressure region are reduced or smoothed by the high-pressure buffer piston 54 and by a pressure limiting valve 56. Since the positive displacement pump is driven synchronously with the camshaft speed, an adequate quantity of pressurized hydraulic fluid is made available for every engine speed, so that faulty operation of the decompression valve is precluded.

Figure 7:
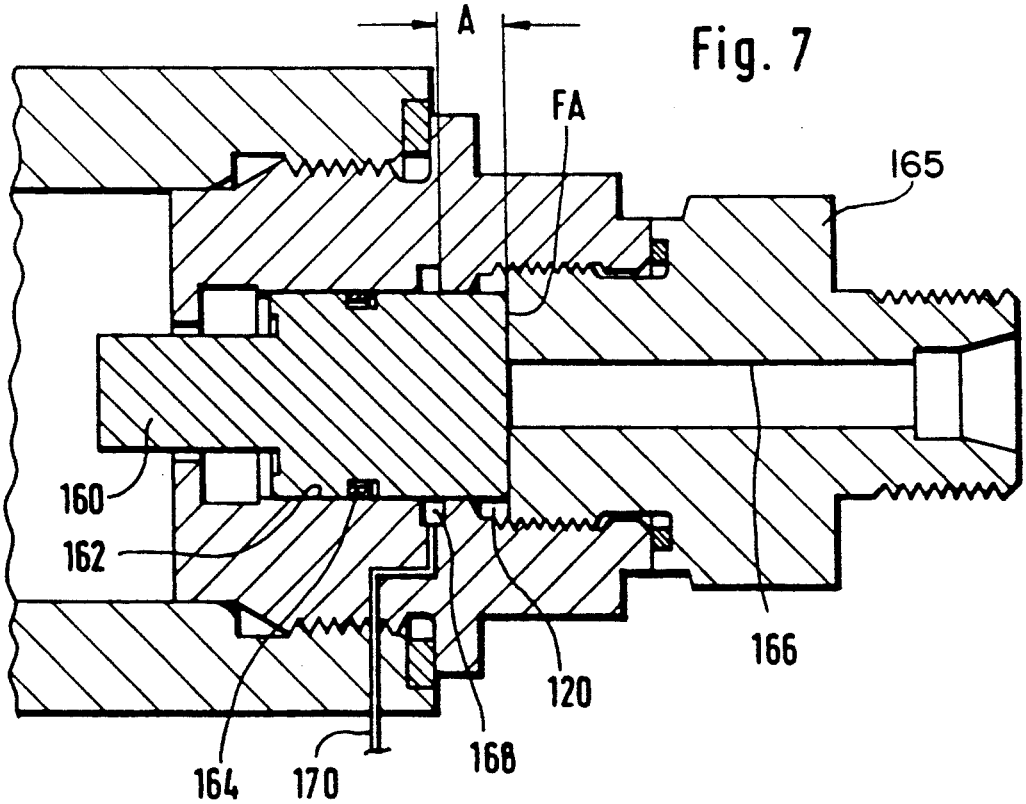
FIG. 7 is a longitudinal section through an actuating hydraulic piston for a decompression valve.

FIG. 7 is a sectional view on a larger scale of how the actuation of a valve piston 160 for a decompression valve is done in detail.

The valve piston 160 is received slidingly displaceably in a bore 162; a ring seal 164 is provided in the region of the sliding fit faces. The control pressure chamber is indicated at 120. It is acted upon by pressure in the control line 14 via a connection part 165 having a bore 166. FIG. 7 shows the stop position of the valve piston 160 this piston assumes under the influence of a restoring spring, not shown, of the valve. At a predetermined distance A from the stop face FA, a plunge cut or recess 168 is provided in the bore 162; it communicates by means of a line 170 with the low-pressure region of the above-described control circuit.

With the imposition of high pressure upon the associated control line 14, the valve piston 160 is displaced counter to the force of the restoring spring so far to the left in FIG. 7, that the stop face FA meets the plunge cut 168. The pressure in the control pressure chamber 120 is then reduced, so that the plunge cut 168 functions as a hydraulic stop.

Figure 8:
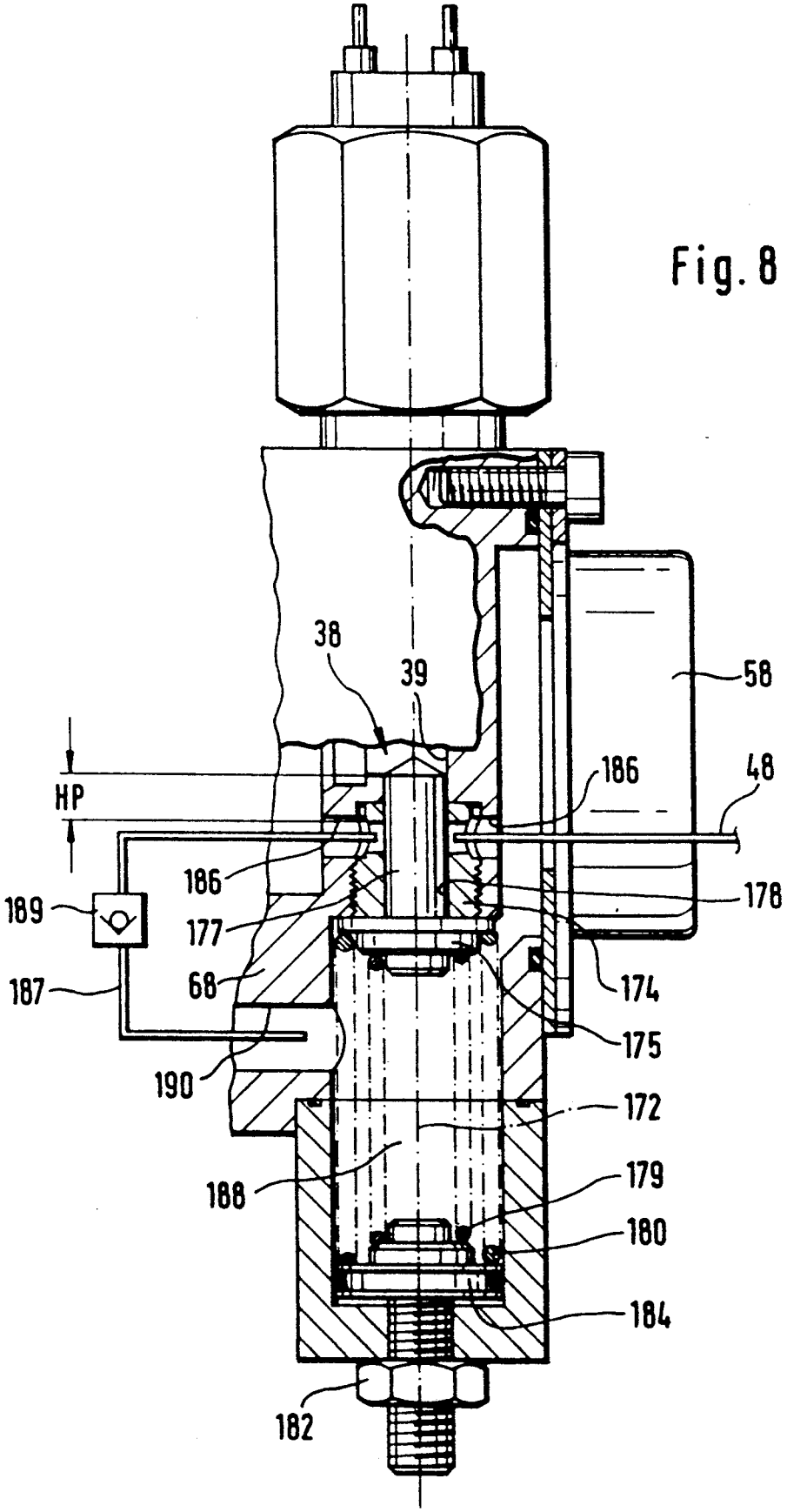
FIG. 8 is a front view seen partly in section, of the end of a housing for the control part of the engine brake, with an integrated pressure limiting valve and high-pressure buffer piston.

Finally, a special embodiment of the pressure limiting valve for smoothing pressure peaks in the high-pressure region will now be described, in conjunction with FIG. 8. The special feature of this embodiment is that the pressure limiting valve is structurally combined with a high-pressure buffer:

FIG. 8 shows the left-hand end of the housing, as seen in FIG. 2, of the control device for the engine brake; the detail of the pressure limiting valve 56 with the integrated high-pressure buffer piston 54 is shown in section. The connection of the pump outlet line is indicated at 38 and is embodied as an outlet end of a bore 39 in the housing 68, having an axis 172. The pressure limiting valve 56, which has a valve insert body 174, is disposed coaxially with the bore 39. A piston 177 serves as the valve body and carries a stepped plate 175 on its end. The piston extends with a close fit into a bore 178 of the valve insert body 174, and in its starting position it closes off a transverse bore 186, which is connected at one end to the relief line 48 and at the other communicates with a low-pressure buffer chamber 188, via a connecting line 187. A check valve 189 may be disposed in the line 187.

The plate 175 is pressed against a stop face by compression springs 179, 180. The helical spring 179, 180 are supported on a support plate 184, which is adjustably mounted on the housing. The axial position of the plate 185 is adjustable by means of a threaded segment and can be locked by means of a check nut 182. Both springs 179, 180 are disposed in the low-pressure buffer chamber 188. The connection of the chamber 188 with the line 187 is indicated at 190.

If a threshold pressure is exceeded, pressure fluctuations of lesser extent connected to the pump outlet line 38 have as a first effect that the piston 177 moves counter to the force of the compression springs 179, 180, as a result of which smoothing of the pressure peaks occurs. The piston executes a travel that corresponds to the prevailing pressure upon an ensuing pressure drop, the piston 177 returns to its terminal position and gives the stored volume of oil back to the system. If the pressure increases further, the piston 177 moves outward over a defined stroke region HP and uncovers the bore 186. As a result, oil drains out to the tank or to the line 48, and the system pressure is limited. The component shown in FIG. 8 accordingly functions as a reservoir, within a predetermined pressure range that can be adjusted at the spring. If the pressure increases beyond that, then it has the function of a pressure limiting valve.

From the above description, it is clear that the special advantage of the engine brake of the invention can be considered to be that with a simple structure, it succeeds in making the necessary high pressure for actuating the various valves available chronologically accurately and in adequate volume; moreover, pressure fluctuations, which particularly at high rpm can cause defective control or inaccuracies in control, are precluded to the maximum extent. The number of rotary leadthroughs or pressure exchanges is minimized according to the invention.

In a departure from the exemplary embodiment described above, it would even be possible to incorporate the multiposition valve 44, along with the pressure limiting valve and thus the entire high-pressure region, in the rotating pump rotor, so that a transition from the rotating to the stationary part in the high- pressure region would be necessary only in the control plane. In this way, pressure losses can be reduced still further.

Figure 9:
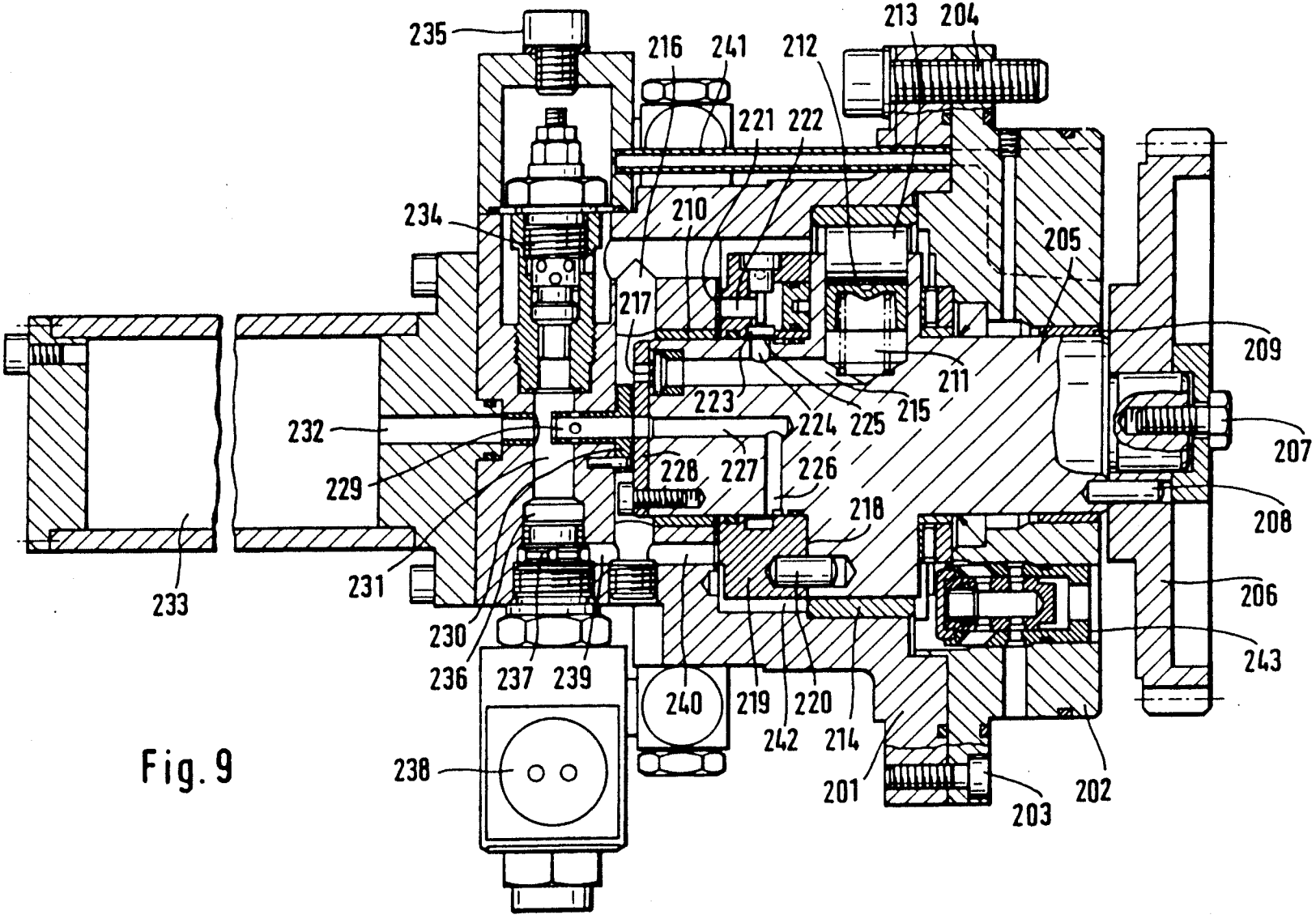
FIG. 9 is a section through the control mechanics of an exemplary embodiment of the engine brake.

The exemplary embodiment of the engine brake shown in FIG. 9 matches the exemplary embodiment of FIG. 2 in many parts. Unless otherwise described below, reference is therefore made to the above description of the associated drawings. One difference from the above-described exemplary embodiment is that the low-pressure pulsation damper 58 of FIG. 2 is replaced with a high-pressure volume resonator 233, and instead of the high-pressure buffer reservoir 54 of FIG. 2, a direct-action pressure limiting valve 234 is used in the pump. With the exception of these differences, the exemplary embodiment of FIG. 9 may be used in combination with a hydraulic control circuit, of the kind shown in FIG. 1 and described in conjunction with it.

A pump, described in further detail hereinafter, is accommodated in a housing comprising multiple parts 201, 202; this pump is similar in structure and function to the pump 18. The parts 201, 202 of the housing are screwed together via a plurality of screws, of which two screws 203, 204 are shown in FIG. 9, screwed in in opposite directions. In the region of the right face end of the housing 201, 202, a gear wheel 206 is screwed by means of a central screw 207 to a pump rotor 205 rotatably supported in the housing. Via a pin 208, the pump rotor 205 and the gear wheel 206 are secured against radial torsion, so that the pump rotor 205 and the gear wheel 206 always revolve at the same rpm. The gear wheel 206 is driven via its external teeth by a further gear wheel in such a way that its rpm always matches the camshaft rpm. Because of the camshaft-synchronous drive of the pump rotor, the pump output automatically varies with the engine speed, so that whatever fluid flow is required at a given time is always assured over the entire rpm range. The pump rotor 205 is rotatably supported on both ends in bearings 209, 210, and in its middle portion it has multiple, preferably 5 radial bores 211, which are distributed over its circumference at equal angular intervals. One cup-shaped positive displacement piston 212, prestressed outward by a spring, is disposed in each radial bore 211 and is supported by its radially outer bottom face on a roller 213. All the rollers 213 roll along an eccentrically supported running surface 214 that surrounds the entire range of revolution of the rollers 213, so that each positive displacement piston 212 executes one pumping stroke and one intake stroke per pump rotor revolution.

Each radial bore 211, with its volume locate radially inside the positive displacement piston 212, forms a work chamber that communicates with an axially extending pressure and suction line 215. The pressure and suction line 215 communicates with a low-pressure intake region 216 via a valve 217, which acts as a check valve and permits a fluid flow from the low-pressure intake region 216 to the pressure and suction line 215, and via that line onward to the work chamber of a positive displacement piston 212 that just at that time is moving outward or in other words is executing an intake stroke, while it blocks a fluid flow in the opposite direction.

A radial shoulder 218 is formed on the pump rotor 205, on the side of the radial bores 211 remote from the gear wheel 206; a control or distributor disk 219 located concentrically with the pump rotor axis rests on this shoulder. The disk 219 is joined to the pump rotor 205 by a pin 220 in a manner fixed against relative rotation and revolves with it. The control disk 219 is mounted axially movably on the pump rotor 205 and is in sliding contact, by its side remote from the gear wheel 206, with an end face 221 of an inner housing shoulder. In the end face 221, distributed uniformly over the circumference, there are axial bores (not shown) that each discharge into connections for individual control lines, which in turn lead to the decompression valve (outlet valve or separate, additional valve) of the applicable engine cylinder.

With the engine brake turned on, the control lines are supplied in succession by means of the control disk 219, in the appropriate rhythm, with pressure for opening the decompression valve and then pressure-relieved again, so that the decompression valve closes again. The control disk 219 may have the embodiment described in conjunction with FIGS. 1 to 8.

The control disk 219 has an axially extending bore 222, located at the level of the control lines, which may optionally have the form of a circular arc—in plan view—and which communicates via a radial bore with an annular chamber 223 that is formed approximately in the middle of the radially inner end face of the control disk 219. Radial tie conduits 224 begin at the individual pressure and suction lines 215 and extend as far as the annular chamber 223. Between the radial tie conduits 224 and the annular chamber 223, there is a valve ring 225 that is formed by an elastic tape. Upon imposition of pressure from a radial tie conduit 224 at this point, the valve ring 225 shifts radially outward into the annular chamber 223, so that fluid can flow into the annular chamber 223. If on the other hand the pressure in the annular chamber 223 is higher than the pressure prevailing in a radial tie conduit 224, then the valve ring 225 closes off the communication between this radial tie conduit 224 and the annular chamber 223 in a fluid-tight manner. Seals that seal off the boundary face between the control disk 219 and the pump rotor 205 and thus prevent leakage are located on both sides of the annular chamber 223.

The annular chamber 223 also communicates with radial tie conduits 226, which are staggered both axially and circumferentially with respect to the radial tie conduits 224. All the radial tie conduits 226 converge in a central axial bore 227 located in the pump rotor axis. The central bore 227 merges with a central recess in a pressure plate 228, which is screwed onto the end face remote from the gear wheel 206 of the pump rotor 205. The central recess in the pressure plate 228 is continued in turn in the form of a through bore 229 of an axial slide block 230, which is sealingly fastened in the housing and is secured against torsion via a pin. The through bore 229 protrudes into a chamber 231 and opens into it.

A connecting conduit 232 that leads to a volume resonator 233 discharges into the chamber 231 in alignment with the through bore 229, from whose mouth it is spaced a short distance away. The volume resonator 233 is designed as a high-pressure volume damper and is screwed onto the housing concentrically with the axis of the pump rotor 205. The volume resonator 233 is embodied as a elongated tube, whose face ends, except for the conduit 232, are sealed off and whose dimensions (diameter, length), are such that in the frequency range used, very good damping action is obtained for pressure surges that arise upon opening and closing of the decompression valves or the like.

A direct-action pressure limiting valve 234 also communicates with the chamber 231. The pressure limiting valve 234 is preferably adjustable; its access opening is closeable via a screw 235. The pressure limiting valve is adjusted to a predetermined limit pressure, and if this limit pressure is exceeded it opens, enabling a pressure reduction from the chamber 231 via the valve 234 and via corresponding bores into the low- pressure work chamber 216. As a result of this preferably adjustable pressure limitation, it is assured that no impermissibly high pressure that could cause damage to the parts to be controlled, or to the seals, can build up in the system.

A bore 236 also discharges into the chamber 231, and a slide 237 of a multiposition valve 238 is disposed in this bore. The multiposition valve 238 is electrically controllable and serves as an on/off switch for turning the engine brake o and off. The slide 237 is shown in the position that is assumes with the engine brake turned on, in other words with the multiposition valve 238 excited. If the multiposition valve 238 is not excited, the slide 237 is retracted at least part way into the multiposition valve 238, so that the bore 236 enters into hydraulic communication with an axially extending bore 239, which in turn communicates hydraulically with the low-pressure work chamber 216. At the same axial level as the bore 239, there is a bore 240 that communicates with it and with the low-pressure work chamber 216 and is sealed off on its side toward the control disk 219.

Extending parallel to the pump rotor axis is a tube 241, which is retained at one end in the housing of the pressure limiting valve 234 and at the other in the housing 201 and carries away a defined volumetric cooling flow from the housing.

The low-pressure intake region 216 communicates with an annular chamber 242, which on the one hand communicates with the pressure relief opening of the control disk 219 and on the other is supplied with the starting pressure of a pressure regulating valve 243 that is built into the housing part 202 and keeps the pressure in the low-pressure region at a constant level, of 1.5 bar, for example.

The engine brake functions as follows: with the engine running, a lubricant oil pump (not shown) furnishes fluid under pressure to the pressure regulating valve 243, which reduces the pressure to approximately 1.5 bar. The low-pressure region of the engine brake control is supplied with this pressure, specifically the annular chamber 242 and the low-pressure intake region 216. The rotating pump rotor 205 compels the rollers 213 to roll along the eccentric running surface 214, so that positive displacement pistons 212 execute intake and compression strokes in alternation. Pressure thus builds up in the axial bores whose positive displacement pistons 212 are performing a positive displacement stroke at that moment, so that the valve ring 225 lifts away from the applicable radial tie conduits 224, and fluid can flow into the annular chamber 223. On the other hand, the positive displacement pistons 212 that at that time are executing an intake stroke bring about such a pressure difference between the annular chamber 223 and the radial tie conduits 224 belonging to it that the valve ring 225 remains closed in these regions, so that no fluid is aspirated out of the annular chamber 223. The valve 217 therefore opens, so that fluid from the low-pressure work region 216 can flow into the work chamber of the positive displacement piston 212 that is moving radially outward. With the multiposition valve 238 opened, the fluid fed into the annular chamber 223 flows via the radial conduits 226 communicating with it and via the central bore 227 into the chamber 231, and through that chamber and the bores 236, 239 returns to the low-pressure work region 216. The fluid loop thus closes, so that the pump is short circuited, and consequently no pressure that would be enough to actuate the decompression valves builds up.

To activate the engine brake, the multiposition valve 238 is switched over. As a result, the hydraulic fluid loop existing up to then is interrupted, so that the fluid backs up in the conduit 226, and bores 227, 229 and the chamber 231, and high pressure builds up. From the annular chamber 223, this high pressure reaches the bore 222 in the control disk 219 and via that disk is transmitted at the appropriate time to the individual decompression valves, so that at the end of each compression stroke, these valves are opened in the various engine cylinders. The ensuing closure of the decompression valves takes place whenever openings communicating with low pressure in the control disk 219 move past the respective associated control line of the applicable cylinder.

Pressure fluctuations, which can happen both when the engine brake is turned on and when it is turned off, are strongly damped by the volume resonator 233, so that the pressure is well smoothed and accordingly there is no danger of incorrect triggering of the decompression valves. The reduction of pressure fluctuations also lessens the mechanical shock wave load on the various components. At the onset of triggering of a decompression valve, the volume reservoir also briefly furnishes a volumetric flow that exceeds the normal pump supply quantity. As a result, the pump may be smaller in size.

Figure 10:
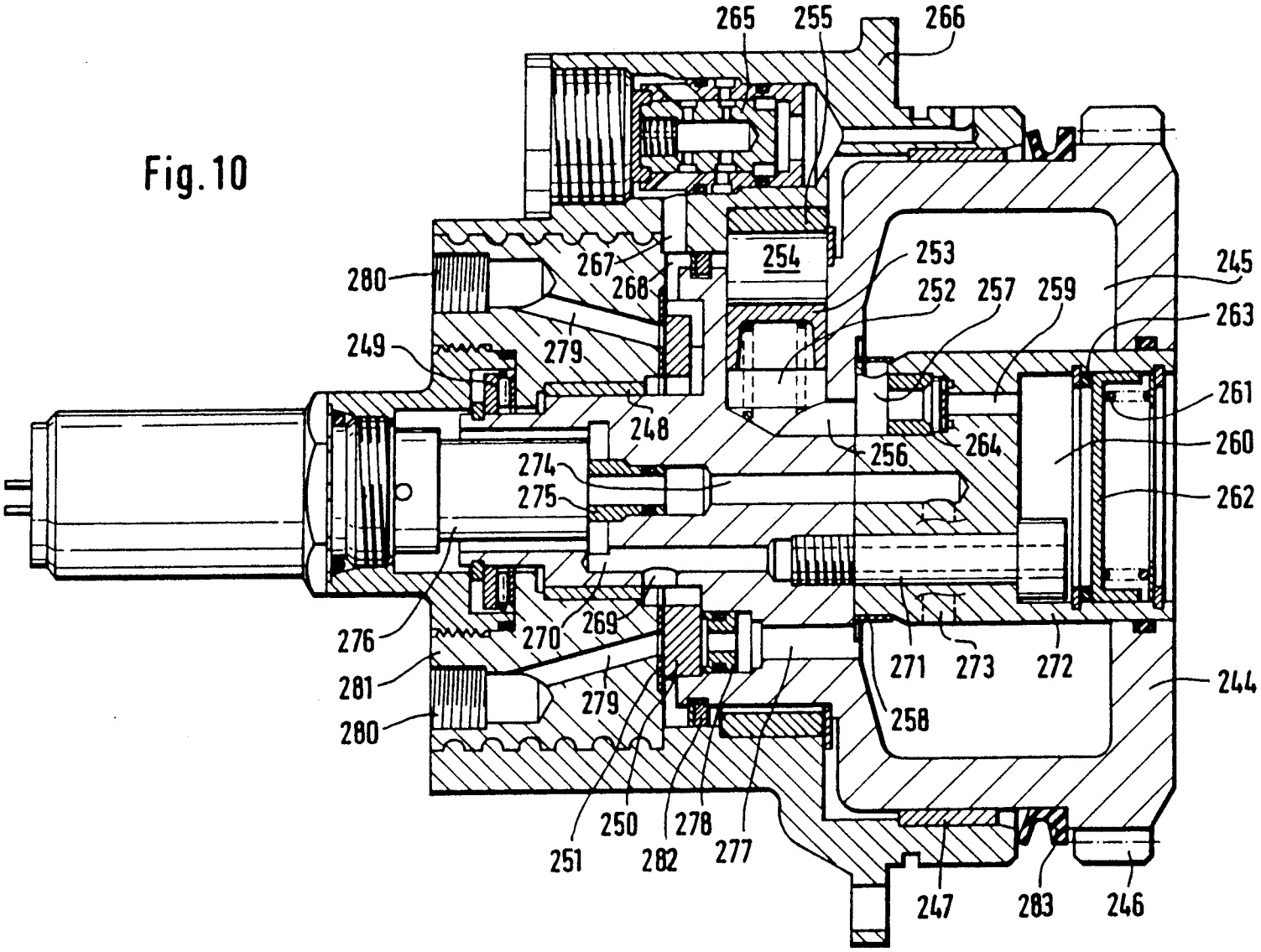
FIG. 10 is a section through a further exemplary embodiment of the engine brake.

FIG. 10 shows another exemplary embodiment of the engine brake according to the present invention. In this exemplary embodiment, the entire high-pressure region, including the volume resonator, is accommodated in the rotary part. A pump rotor 244 is widened on its right-hand side (as seen in FIG. 10), and it encompasses an internal hollow space 245, which serves as a volume resonator and is sealed off from the atmosphere. The pump rotor 244 has external teeth 246 on its outer circumference, by way of which teeth it can be driven by the engine crankshaft (not shown) or interposed gear wheels. The driving gear ratio is set such that the pump rotor always revolves at the rpm of the camshaft. The pump rotor 244 is rotatably supported in slide bearings 247 and 248, of which the slide bearing 247 is disposed on the outer circumference of the widened rotor portion encompassing the volume resonator 245, and the slide bearing 248 is disposed in the left- hand end region of the rotor (as seen in FIG. 10). To support the pump rotor 244, there is also an axial roller bearing 249, which is disposed on the side of the slide bearing 248 remote from the outer teeth 246 and which absorbs axial forces that arise in the pressure field between a rotating control disk 250 and a stationary stop disk 251.

As in the exemplary embodiment of FIG. 9, in the present exemplary embodiment of FIG. 10 as well the pump rotor 244 is equipped with a multiple-piston positive displacement pump, and to that end has multiple, preferably five, radial bores 252, in which positive displacement pistons 253 that are spring-prestressed outward can move up and down in the radial direction. The positive displacement pistons 253 rest with their radially outer surfaces on rollers 254 and via them on a fixed eccentric race 255. Upon the pump rotor rotation, the positive displacement pistons 253 are thus moved radially up and down and in the process execute an intake stroke during the outward motion and a compression stroke during the inward motion.

On their side located radially inside the positive displacement pistons 253, the radial bores 252 communicate with axial bores 256, from each of which one radial tie conduit 257, leading upward in the view of FIG. 10, leads to the volume resonator 245. The region of the outlet openings of the radial tie conduits 257 to the volume resonator 245 is in each case closed off with a valve in the form of an encompassing valve tape 258, which upon a compression stroke of the positive displacement pistons frees the communication between the radial tie conduit 257 and the volume resonator 245, while in a suction stroke of the associated positive displacement piston 253, it seals off the tie conduit 257 from the volume resonator 245.

The axial bore or conduit 256 also communicates via an axial conduit 259 with a low-pressure damper chamber 260 that is disposed concentrically in the interior of the volume resonator 245. The damping chamber 260 serves to smooth pressure fluctuations in the low-pressure region and is provided with an axially displaceable piston 262 that is acted upon by a spring 261 and upon pressure surges executes corresponding compensation motions, thus contributing to reducing the pressure fluctuations. An elastomer seal 263 rests on the periphery of the end face of the piston 262 toward the axial bore 259; upon a standstill, this seal seals off the pump interior in cooperation with the spring- loaded piston 262.

One valve 264, which is embodied as a suction valve or valve plate, is located between each of the axial bores 256 and 259. The valve 264 opens when the associated positive displacement piston 253 executes an intake stroke, and it thus frees the communication of the axial conduit 256 with the damping chamber 260, or in other words with the low-pressure side, While it sealingly closes off the conduit 259 when a compression stroke is executed.

The delivery of the low pressure to the damping chamber 260 takes place as follows:

A pressure regulating valve 265 is disposed in a stationary housing part 266 and communicates on the inlet side with the pressure side of a lubricant oil pump, not shown. The pressure regulating valve 265 regulates the pressure to a fixed value of approximately 1.5 bar. Via a conduit 267, beginning at the pressure regulating valve 265, the regulated low pressure is carried to an annular chamber 268 and from there reaches the control or distributor disk 250 on the one hand and an axial conduit 270, via a radial conduit 269 in the pump rotor 244, on the other; the conduit 270 discharges into the damping chamber 260, via the passage through a hollow screw 271.

The hollow screw 271 serves not only to carry the low pressure but at the same time also to mechanically fasten an insert 272, which is received in the volume resonator housing in a sealed-off manner and carries the damping chamber 260 together with the piston and spring and contains the conduits 257 and 259 and the valve 264.

At least one continuously open radial bore 273, which is axially and radially staggered with respect to the radial bore 257 and connects the interior of the volume resonator 245 to a concentric axial bore 274, is located in the insert 272. This assures an adequate, symmetrical fluid flow. Because of the mutual staggering of the radial bores 257 and 273 and a bore 277 to be described later, a flow through the volume resonator volume is achieved, so that the pulsation smoothing carried out in the high-pressure region by the volume resonator 245 is improved still further.

The axial bore 274 extends part way through the insert 272 and also through the shaft of the pump rotor 244 and discharges into an axial pressure transmission 275. The axial pressure transmission 275 cooperates with an electrically controllable pressure limiting valve 276 that is kept stationary.

With the pressure limiting valve 276 opened, the supply fluid can flow virtually without pressure loss via the axial pressure transmission 275 through the pressure limiting valve DBE 276 to the low-pressure region. This is equivalent to the system state in the driving mode, in which the engine brake is inactivated. The following fluid flow is obtained in this system state: the fluid that has flowed from the pressure regulating valve 265 to the damping chamber 260 is aspirated via the valve 264 into the bore 256 in the pump interior upon each pump intake stroke, after which in the ensuing pumping stroke it flows via the tie conduit 257 directly into the volume resonator 245. From there, the hydraulic fluid flows via the radial conduit or conduits 273 to the central bore 274 and to the axial pressure transmission 275 to the pressure limiting valve 276, from which it can flow back virtually without pressure to the pump intake side, via the conduit 270 and the interior of the hollow screw 271 and via the damping chamber 260. The hydraulic fluid loop is thus short-circuited.

With the engine brake switch on, the pump high pressure is defined by the pressure limiting valve 276. The pressure limiting valve can preferably be controlled in analog fashion, so that the magnitude of the hydraulic fluid throughput from the axial pressure transmission 275 to the conduit 270 can be controlled in analog fashion between zero and maximum. As a consequence, the level of the pump pressure that is established can be controlled variably via the magnitude of the electrical triggering of the pressure limiting valve 276. The pressure limiting valve 276 thus acts like a hydraulic dimmer circuit. At the same time, the pressure limiting valve 276 also acts as an overpressure valve, which opens automatically if a limit pressure is exceeded and as a result effects an immediate reduction in the pump overpressure. With the engine brake switched on, and with the pump pressure defined by the pressure limiting valve 276, the hydraulic fluid at high pressure flows via a conduit 277 extending axially from the volume resonator 245 to a pressure leadthrough 278, which is in contact with the side of the control disk remote from the stop disk 251. Via a corresponding axial passage in the control disk 250, the fluid at high pressure then reaches the opposite side of the control disk and—depending on the orientation—flows into one (or more) conduits 279. The conduits 279 are distributed at equal circumferential intervals and discharge obliquely into drains 280. The drains 280 communicate with control lines that each lead to one of the decompression valves. As a result, the decompression valves are opened in the correct rhythm.

The control disk 250 is provided with further axial passages, by way of which the low pressure picked up by the pressure regulating valve 265 can reach the side of the control disk aligned with the stop disk 251 from the back side of the control disk. The hydraulic fluid at low pressure can be carried from the annular chamber 268 via corresponding circumferential recesses on the outside of the control disk 250 to the axial passages to be acted upon by low pressure.

As in the embodiment of FIGS. 1 to 8, the control disk may be slit with circular arc-shaped slits on its side toward the stop disk 251, in order to adapt the duration of action of the high pump pressure or of the low pressure on the decompression valves to the required values.

Accordingly, only axial passages—and optionally outer recesses for guiding the pump intake pressure to the corresponding axial recesses—are needed in the control disk 250. Radial bores can accordingly be dispensed with. This has the advantage that the control disk 250 can be produced in a simple manner from ceramic material by a sintering process and therefore has extremely high erosion resistance and a long service life.

As a result of the high pressure of the pump acting upon the back side of the control disk 250 in the region of the pressure leadthrough 278, the control disk 250 is at the same time prestressed hydraulically against the stop disk 251, so that a sealing contact is produced.

The drains 280 are integrated with a part 281 made of steel, which is cast in the aluminum housing 266.

Cooling of the hydraulic fluid can be obtained in a simple manner in that a defined cooling flow drains out continuously via the close-fit play of the piston 262; this flow is replaced with fresh oil at the inlet of the system by the pressure regulating valve 265.

A steel rotary seal 282 is located on the outer circumference of the pump rotor 244, on the side of the radial bores 252 remote from the volume resonator 245; this seal rests with its outer circumference on the stationary housing part 266 and seals off the pressure region on the intake side from the atmosphere.

An elastomer seal 283 is also located between the outer teeth 246 of the pump rotor 244 and the slide bearing 247 and acts as an idling protector at standstill.

Figure 11:
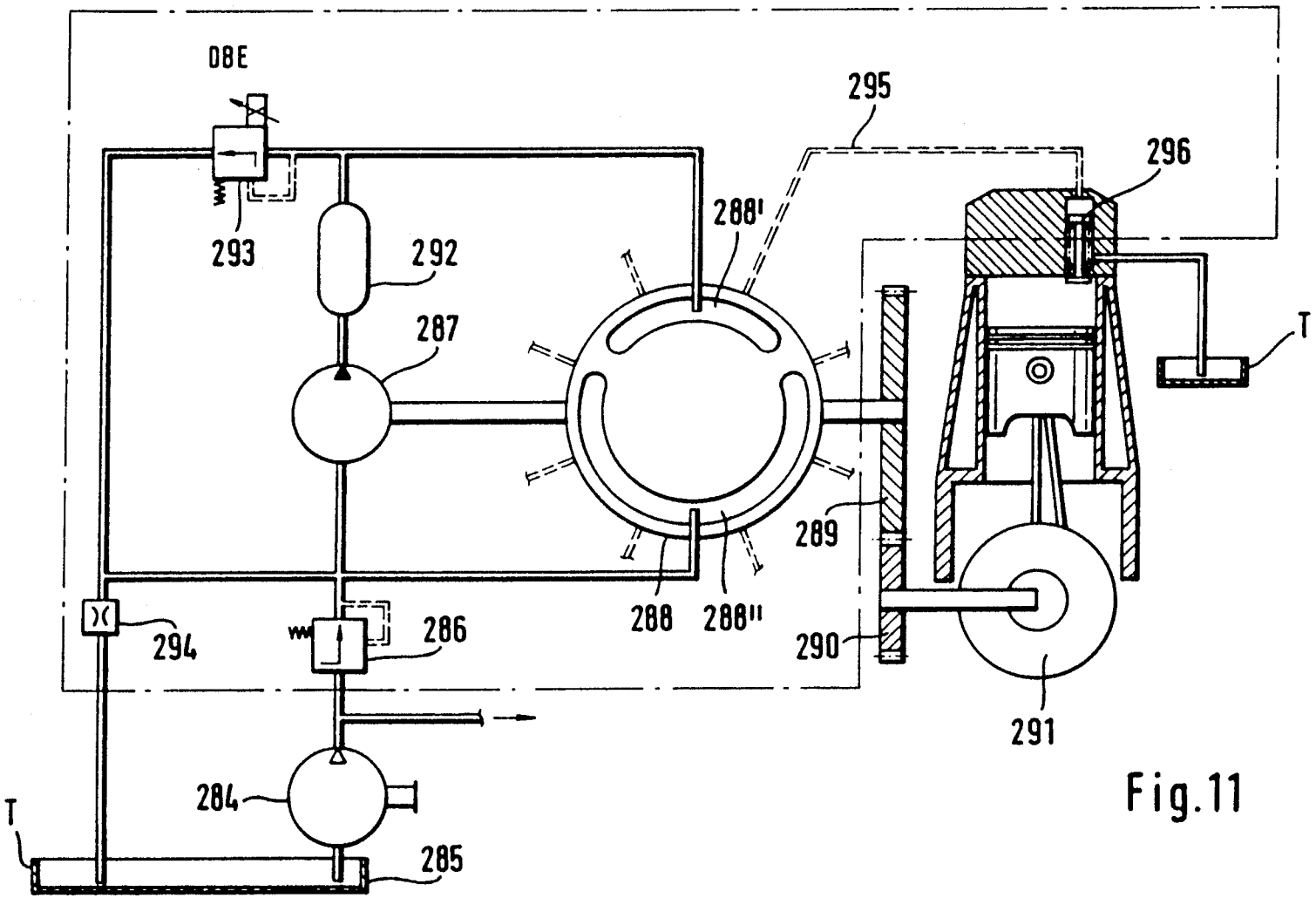
FIG. 11 is a schematic block circuit diagram of an exemplary embodiment of the hydraulic control circuit for the engine brake.

FIG. 11 is a schematic block circuit diagram of the hydraulic control circuit for the engine brake, in the form that can be used on the exemplary embodiments of FIGS. 9 and 10. A lubricant oil pump 284 pumps lubricant oil from a tank 285 to a pressure regulating valve 286, which corresponds to the pressure regulating valves 243 and 265 of FIGS. 9 and 10, respectively, and regulates the starting pressure to a value of approximately 1.5 bar. A pump 287, corresponding to the radial piston pump shown in FIGS. 9 and 10 with respective positive displacement pistons 212 and 253 communicates on the intake side with the pressure regulating valve 286 and is driven jointly with a distributor or control disk 288 via a gear wheel 289, which corresponds to the gear wheels 206 and outer teeth 246 in FIGS. 9 and 10, respectively. The gear wheel 289 is driven at a gear ratio of 1:2 by a gear wheel 290 that revolves with a crankshaft 291. The pump 287 acts on the outlet side upon a volume resonator 292, which on its outlet side communicates on the one hand with a slit 288' of the control disk 288 and on the other with an electrically controllable, adjustable pressure limiting valve 293. The pressure limiting valve 293 is embodied as a proportional pressure limiting valve and makes it possible to perform the following functions simultaneously, with only a single valve:

1) switchover from the drive mode state of the system, with pressureless circulation of the pumped medium via the pressure limiting valve 293, to the brake mode state of the system in which the magnetic current applied to the pressure limiting valve 293 defines the system pressure;

2) maximum pressure limitation of the system pressure; and 3) brake output adjustable in infinitely graduated form by varying the pressure in the high-pressure region. It has been found that the extension travel of the actuating pistons of the decompression valves is directly dependent on the pressure level at the pump 287. By varying the pressure via the pressure limiting valve 293, the engine braking output can thus be adjusted in an infinitely graduated manner in an extremely simple way.

On the outlet side, the pressure limiting valve 293 communicates both with the intake side of the pump 287 and, via a throttle 294, with the tank. A small leakage flow drains continuously away to the tank 285 via the throttle 294; it is replaced with cold fresh oil by the lubricant oil pump 284. This produces automatic cooling of the engine braking system.

A circular ar slit 288" communicates with the intake side of the pump 287. Control line 295 also begin at the control disk 288, each communicating with one decompression valve 296, to enable opening and closing this valve at the correct rhythm. For description of the mode of operation of the control circuit of FIG. 11, reference is made to the description of FIGS. 1 to 8, although components 44 and 56 shown in FIG. 1 have been replaced with the pressure limiting valve 293, and a volume resonator 292 is used here instead of the high-pressure reservoir 54 of FIG. 1.

In an alternative exemplary embodiment of the engine brake of the invention, it is also possible, however, to dispense with the volume resonator 292 or replace it with a piston-type high-pressure reservoir or the like. In the same way, it is possible to dispense with the control disk 288, and to distribute the system high pressure at the correct rhythm to the decompression valves 296 in some other way, for example by incorporating separately controllable switching valves into the control lines 295. The variable pressure regulation by means of the pressure limiting valve 293 can thus be used for variable engine braking output, with engine brakes embodied differently. However, the use of a distributor disk 288 is preferred, because it enables extremely simple pressure distribution to the various control lines.

Naturally, the engine brake can be operated with other valves than outlet valves in the form of decompression valves. It would also be possible to close the outlet valve periodically in the exhaust stroke of the engine. One control line could also be associated with a plurality of valves.

The invention accordingly creates an engine brake for a multicylinder engine, with valves that can be opened briefly, periodically, outside the exhaust stroke; in the region of the applicable valve drive, a hydraulic piston is provided, which is triggered synchronously with the engine rpm via an associated control line by a hydraulic pressure distributor fed by a pump. To improve the accuracy of control over the entire engine rpm range, the various valves are assigned a central positive displacement pump that runs synchronously with the camshaft rpm and whose outlet line leads to the hydraulic pressure distributor, which has a distributor disk. By means of the distributor disk, in the engine braking mode, an alternating connection of the applicable control line to either the pump outlet line or a low-pressure region of the hydraulic control circuit is effected synchronously with the engine rpm.

What is claimed is:

1. An engine brake for a multicylinder internal combustion engine comprising:

(a) a decompression valve connected to each cylinder of the multicylinder internal combustion engine;

(b) a plurality of hydraulic pistons, each of said plurality of hydraulic pistons being connected to one of said decompression valves;

(c) a positive displacement pump, having an inlet line and an outlet line, being actuated synchronously with a camshaft of said multicylinder internal combustion engine;

(d) a hydraulic pressure distributor being actuated synchronously with said camshaft and being in fluid communication with said outlet line; and (e) a plurality of control lines extending out of said hydraulic pressure distributor and providing fluid communication with said plurality of hydraulic pistons, said hydraulic pressure distributor being in selective fluid communication with each of said control lines and a low pressure region, said selective fluid communication being synchronous with said camshaft of said internal combustion engine so that each of said decompression valves is opened in the vicinity of a compression and ignition reversal point of an operating piston of the multicylinder internal combustion engine, said low pressure region being in fluid communication with said inlet line of said positive displacement pump.

2. The engine brake of claim 1, wherein the hydraulic pressure distributor revolves together with the positive displacement pump at substantially the same rpm.

3. The engine brake of claim 2, wherein the hydraulic pressure distributor is driven together with a rotor of the positive displacement pump.

4. The engine brake of claim 3, wherein the low-pressure region includes an intake side of the positive displacement pump.

5. The engine brake of claim 4, wherein the positive displacement pump s a radial piston pump.

6. The engine brake of claim 5, wherein the radial piston pump includes five pistons.

7. The engine brake of claim 6, wherein the radial piston pump pistons are supported radially toward the outside by a roller on an eccentric running surface, the pistons are movable radially inward counter to the force of a restoring spring thereby reducing the size of a pump work chamber.

8. The engine brake of claim 7, wherein the radial piston pump pistons are slidingly displaceably received in the rotor on one end a portion for coupling with a drive and on an opposite end cooperates with a housing recess that defines a low-pressure intake chamber.

9. The engine brake of claim 8, further including one substantially axially aligned suction and pressure conduit which communicates with each pump work chamber and the low-pressure intake, a suction valve being between the low-pressure intake chamber and the axially aligned conduit.

10. The engine brake of claim 9, further including one tie conduit, extending substantially radially outward, from the axially aligned conduit, the tie conduit being in fluid communication with an annular chamber in the hydraulic pressure distributor mounted on the rotor, an elastic valve ring is between the tie conduit and the annular chamber, the valve ring, in the intake phase of the applicable piston, closes the fluid communication between the tie conduit and the annular chamber and, in the compression phase, opens the fluid communication between the tie conduit and the annular chamber.

11. The engine brake of claim 10, wherein the annular chamber communicates via a plurality of radial conduits, which are circumferentially spaced apart uniformly from one another, with a central axial bore.

12. The engine brake of claim 11, wherein the rotary leadthrough includes a slide block that is axially movably supported in a housing, coaxially with the rotor, the slide block is supported on a pressure disk that is mounted on the opposite end of the rotor.

13. The engine brake of claim 12, wherein the slide block is received in a sealed-off fashion in an axial bore of the housing, the diameter of the axial bore is greater than an inside diameter of a recess in a sliding contact face of the slide block.

14. The engine brake of claim 13, wherein the hydraulic pressure distributor is fixedly mounted to rotation and is mounted to be axially movable on the rotor, the hydraulic pressure distributor provides communication, in the region in which the pistons of the positive displacement pump execute a positive displacement stroke, between the annular chamber and a circular segment slit recess, in an end face of the distributor disk located in a control plane of the distributor disk.

15. The engine brake of claim 14, further including a further circular arc slit in the end face of the distributor disk, on the radius of the circular segment slit recess, the circular arc slit communicating with the low-pressure intake chamber.

16. The engine brake of claim 15, further including discharge openings from the control lines leading to each of said outlet valves, the discharge openings are located on the other side of the control plane, on the radius of the slit recesses.

17. The engine brake of claim 16, wherein the hydraulic pressure distributor is supported on a shoulder of the rotor, by a support end face remote from the control plane.

18. The engine brake of claim 17, wherein the support end face has an indentation, substantially in axial alignment with the circular segment slit recess and is enclosed by a seal, the face of the indentation is larger than the face of the circular segment slit recess and hydraulically communicates with the circular segment slit recess.

19. The engine brake of claim 18, wherein the annular chamber is in the distributor disk and is sealed off from the control plane by means of a seal.

20. The engine brake of claim 19, wherein the pump outlet line is connected to a relief line, via a triggerable multiposition valve, to deactivate the engine brake.

21. The engine brake of claim 20, further including a pressure limiting valve connected in parallel to the multiposition valve.

22. The engine brake of claim 21, wherein the pump outlet side communicates hydraulically with a high-pressure buffer piston.

23. The engine brake of claim 22, wherein the relief line communicates with the low-pressure region.

24. The engine brake of claim 22, wherein the high-pressure buffer piston and the pressure limiting valve are a unit.

25. The engine brake of claim 24, wherein the low-pressure region is located downstream of a pressure regulating valve.

26. The engine brake of claim 25, wherein the low-pressure region is connected to a low-pressure damping device, the low pressure damping device being a bellows reservoir mounted coaxially on the rotor housing.

27. The engine brake of claim 26, wherein the low-pressure region is relieved to the tank via a scavenging oil line, the scavenging oil line having a drain throttle.

28. The engine brake of claim 27, wherein the hydraulic piston includes a hydraulic stop as a stroke limitation.

29. An engine brake for a multicylinder internal combustion engine comprising:

(a) a decompression valve included within each cylinder of the multicylinder internal combustion engine;

(b) a plurality of hydraulic pistons, each of said plurality of hydraulic pistons being connected to one of said decompression valves;

(c) a positive displacement pump, having an inlet line and an outlet line, being actuated synchronously with the operation of said multicylinder internal combustion engine;

(d) a hydraulic pressure distributor being actuated synchronously with the operation of said multicylinder internal combustion engine, said outlet line being in fluid communication with said hydraulic pressure distributor; and (e) a plurality of control lines extending out of said hydraulic pressure distributor and providing fluid communication with said plurality of hydraulic pistons, said hydraulic pressure distributor being in selective fluid communication with each of said control lines and a low pressure region, said selective fluid communication being synchronous with said camshaft of said internal combustion engine so that each of said decompression valves is opened in the vicinity of a compression and ignition reversal point of an operating piston of the multicylinder internal combustion engine, said low pressure region being in fluid communication with said inlet line of said positive displacement pump, said outlet line being in fluid communication with a volume resonator to smooth pressure pulsations.

30. The engine brake of claim 29, wherein the volume resonator is disposed in stationary fashion.

31. The engine brake of claim 30, wherein an inlet opening of the volume resonator is aligned axially with a conduit that rotates with the pump rotor and is in fluid communication with the outlet line of the positive displacement pump.

32. The engine brake of claim 31, wherein an outlet opening of the conduit discharges into a chamber in which a pressure limiting valve is located.

33. The engine brake of claim 32, wherein the chamber communicates, via a valve, with a low-pressure region to turn off the engine brake, the low pressure region is in fluid communication with a pump intake region.

34. The engine brake of claim 29, wherein the volume resonator revolves with a pump rotor.

35. The engine brake of claim 34, wherein the volume resonator is integrated with the pump rotor.

36. The engine brake of claim 35, wherein the inflow and outflow conduits of the volume resonator are staggered axially and radially relative to one another.

37. The engine brake of claim 36, further including a low-pressure damping chamber is disposed in the interior of the volume resonator.

38. The engine brake of claim 37, wherein the low-pressure damping chamber includes an axially displaceable piston.

39. The engine brake of claim 38, further including a conduit for delivering the positive displacement pump high pressure fluid to the hydraulic pressure distributor, the conduit discharges on a face end thereof remote from the control lines.

40. The engine brake of claim 39, wherein the hydraulic pressure distributor has solely axially extending conduits for carrying the positive displacement pump fluid to the control lines.

41. The engine brake of claim 40, wherein the hydraulic pressure distributor is made of a sintered ceramic material.

42. The engine brake of claim 41, further including a stationary pressure limiting valve, the stationary pressure limiting valve is disposed concentrically with the pump rotor.

43. The engine brake of claim 42, further including an axial pressure leadthrough disposed between the pressure limiting valve and an axial conduit which communicates with the volume resonator.

44. An engine brake for a multicylinder internal combustion engine comprising:

(a) a decompression valve included within each cylinder of the multicylinder internal combustion engine;

(b) a plurality of hydraulic pistons, each of said plurality of hydraulic pistons being connected to one of said decompression valves;

(c) a positive displacement pump, having an inlet line and an outlet line, being actuated synchronously with a camshaft of said multicylinder internal combustion engine;

(d) a hydraulic pressure distributor being actuated synchronously with said camshaft of said multicylinder internal combustion engine, said outlet line being in fluid communication with said hydraulic pressure distributor;

(e) a plurality of control lines extending out of said hydraulic pressure distributor and providing fluid communication with said plurality of hydraulic pistons, said hydraulic pressure distributor being in selective fluid communication with each of said control lines and a low pressure region, said selective fluid communication being synchronous with said camshaft so that each of said decompression valves is opened in the vicinity of a compression and ignition reversal point of an operating piston of the multicylinder internal combustion engine, said low pressure region being in fluid communication with said inlet line of said positive displacement pump; and (f) an electrically actuated pressure limiting valve being in fluid communication with said outlet line, the pressure limiting valve being adjustable to control a fluid pressure in communication with the hydraulic pressure distributor.

45. The engine brake of claim 44, wherein the pressure limiting valve is a proportional pressure limiting valve.

46. A method for varying the adjustment of the braking valve in a multicylinder internal combustion engine comprising the steps of:

(a) actuating a positive displacement pump synchronously with a camshaft of the internal combustion engine;

(b) actuating a hydraulic pressure distributor synchronously with the camshaft of the internal combustion engine; and (c) selectively opening an outlet valve in each cylinder of the internal combustion engine in synchrony with the camshaft of the internal combustion engine during a period of time in the vicinity of a compression and ignition reversal point of an operating piston of the internal combustion engine, the opening of the outlet valves being in response to a fluid pressure exiting from the positive displacement pump and being selectively applied to open the outlet valves by the hydraulic pressure distributor.

* * * * *